US005715707A

United States Patent [19]

Makiyama et al.

[11] Patent Number: 5,715,707

[45] Date of Patent: Feb. 10, 1998

[54] PILE COMPOSITE WITH SPECIFIC APPEARANCE

[75] Inventors: Muneto Makiyama, Kobe; Kazuya Kusunoki, Hyogo-ken; Yoshitomo Matsumoto, Takasago, all of Japan

[73] Assignee: Kanegafuchi Kagaku Kogyo Kabushiki Kaisha, Osaka, Japan

[21] Appl. No.: 676,511

[22] Filed: Jul. 8, 1996

Related U.S. Application Data

[63] Continuation-in-part of Ser. No. 525,101, Sep. 8, 1995, abandoned.

[30] Foreign Application Priority Data

Sep. 12, 1994 [JP] Japan ..... 5-216946

[51] Int. Cl.[6] ..... D04B 1/02; D04B 9/14; D06C 23/02

[52] U.S. Cl. ..... 66/194; 66/9 B; 28/160

[58] Field of Search ..... 66/9 B, 194; 28/160

[56] References Cited

U.S. PATENT DOCUMENTS 3,461,689 8/1969 Herkenberg .
3,641,635 2/1972 Martin .
3,684,284 8/1972 Tranfield .
3,732,135 5/1973 Ernst et al. .
3,820,358 6/1974 Frishman .
4,236,286 12/1980 Abler et al. .
4,576,611 3/1986 Pascoe, Sr. .
5,460,016 10/1995 Kuhrau et al. .

FOREIGN PATENT DOCUMENTS 260 954 10/1988 Germany .

OTHER PUBLICATIONS

Daniel Frishman, President, Fibresearch Corp., "Pile Fabrics", 1966.

*Primary Examiner*—John J. Calvert
*Attorney, Agent, or Firm*—Armstrong,Westerman,Hattori,McLeland & Naughton

[57] ABSTRACT

A pile composite with specific appearnace comprising a pile fabric obtained by sliver knitting process, the pile fabric including a ground fabric, substantially straight piles and cone shape piles, both of the piles being developed on a surface of the ground fabric, wherein the cone shape piles are scattered all over the ground fabric and a total area of the cone shape piles at middle portions of the cone shape piles is from 0.5 to 15% of an area of the ground fabric. The pile composite has a specific appearance in which a large number of cone shape piles are developed on the surface of the pile fabric. The method for preparing the pile composite is also disclosed.

1 Claim, 4 Drawing Sheets

PILE COMPOSITE WITH SPECIFIC APPEARANCE

CROSS-REFERENCE TO RELATED APPLICATION

This is a continuation-in-part of application Ser. No. 525,101 filed on Sep. 8, 1995 now abandoned.

BACKGROUND OF THE INVENTION

The present invention relates to a pile composite with specific appearance to a process for preparing the same, and more particularly to a pile composite with completely new, specific appearance which provides a soft touch and develops specific coloring effects and to a process for preparing the same.

A pile composite mainly comprises a ground fabric and piles, and is prepared by a woven pile process, a knitted boa process, a sliver knitting process, a raschel process, a needle-punched nonwoven fabric process and the like.

A pile composite with specific appearance is prepared by giving patterns by jacquard weaving or knitting, by giving specific colors by textile printing or discharge printing, by giving uneven feel by pattern weaving or knitting, or by giving a specific form by pressing process, tumbler processing and the like.

Until now, pile composites with specific appearance have been prepared, but a great need exists for a pile composite with a specific appearance different from that of conventional ones.

The present invention has been made to provide a new pile composite with specific appearance which is strongly needed as described above.

As a result of earnestly repeated investigations with paying attention to the sliver knitting process, in order to provide a pile composite with soft touch and excellent coloring effects which has completely new and specific appearance as well as a process for preparing the same, there has been found a possibility for preparing a pile composite with completely new and specific appearance that has never been achieved by any conventional process by using specific pile material and a special accessory which is attached to the sliver knitting machine and by combining specific methods for a finishing process, and thus the present invention has been completed.

SUMMARY OF THE INVENTION

In accordance with the present invention, there is provided a pile composite with specific appearance comprising a pile fabric obtained by sliver knitting process, the pile fabric including a ground fabric, substantially straight piles and cone shape piles, both of the piles being developed on a surface of the ground fabric, wherein the cone shape piles are scattered all over the ground fabric and a total area of the cone shape piles at middle portions of the cone shape piles is from 0.5 to 15% of an area of the ground fabric; and a process for preparing a pile composite with specific appearance in which the pile composite comprises a pile fabric which includes a ground fabric, substantially straight piles and cone shape piles, both of the piles being developed on a surface of the ground fabric and in which the cone shape piles are scattered all over the ground fabric and a total area of the cone shape piles at middle portions of the cone shape piles is from 0.5 to 15% of an area of the ground fabric, comprising: providing an accessory with a presser doglegged against a support close to a latch needle inside a cylinder of a sliver knitting machine; knitting a pile fabric; carrying out combined processing of shearing; brushing and polishing; and finally carrying out tumbler processing.

The pile fabric in the present invention comprises a ground fabric and piles which include cone shape piles and other substantially straight plain piles. The cone shape piles having a long pile length are scattered all over the ground fabric and among other plain piles, so that the pile fabric gives a clearly new shape which appeals to the human eye.

DETAILED DESCRIPTION

Figure 1:
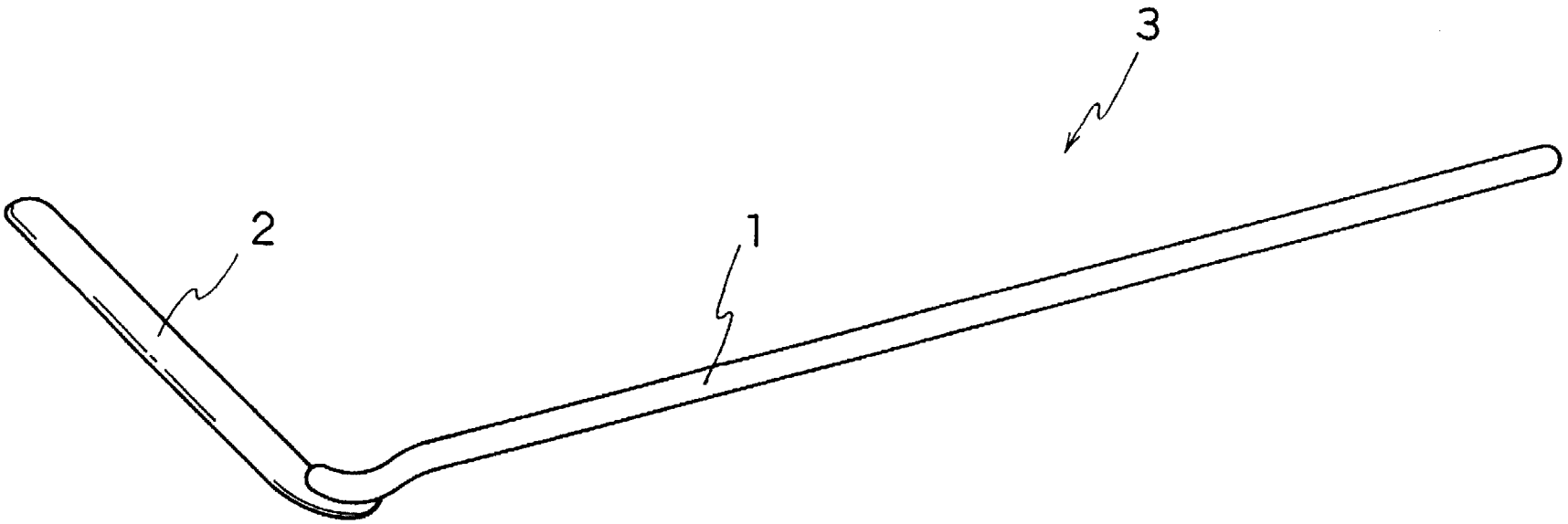
FIG. 1 is a schematic representation of one example of an accessory to be mounted near a card or doffer of a sliver knitting machine in the preparation process according to the present invention.

The pile composite of the present invention comprises a ground fabric, piles and adhesive resin to be applied, as required, to the rear surface of the pile used.

For the ground fabric, there is no limitation as long as it is a ground fabric used for manufacturing pile fabric by sliver knitting process and it can produce cone shape piles of which total area at their middle portions (refer to M in FIG. 3*d* which is in the middle of pile height) is from 0.5 to 15% of an area of the ground fabric (the number of cone shape piles is 1000–8000 pieces/$m^2$), but a preferred embodiment is given for the case of knitted ground fabric prepared from spun yarns of polyester fibers, polypropylene fibers, or acrylic fibers, or cotton fibers or from filament yarns of polyester fibers, polypropylene fibers.

The pile is produced by knitting slivers formed from the pile material fiber into the ground fabric by sliver knitting process and then finishing the same.

Examples of the pile material fiber include synthetic fibers such as modacrylic fibers, acrylic fibers, polyester fibers, and polyamide fibers as well as natural fibers such as cotton and wool. In particular, to obtain a soft touch, it is preferable to modify or permanently soften the fiber surface.

For the pile material fiber, it is desirable that 30–70% (weight %, hereinafter the same), preferably 50–65% of a pile material A of 2–7 d (denier), preferably 3–5 d in fineness and of 25–76 mm, preferably 32–51 mm fiber length is mixed with 70–30%, preferably 50–35% a pile material B of 5–20 d, preferably 6–15 d in fineness and of 25–76 mm, preferably 32–51 mm in fiber length. In this event, it is desirable that the fineness of the pile material B is greater than that of the pile material A from a viewpoint of the improved profile of the cone shape pile described later.

The pile material A is designed to entangle the pile material B, and it is important that the pile material A has the fineness and fiber length stated above in order to constitute cone shapes capable of appealing to the human eye.

On the other hand, the pile material B is positioned at a center of a cone. The pile material A entangles the pile material B to form a cone shape capable of appealing to the human eye. In particular, it is important that the tip portion of the cone extends straight. For this reason, the pile material is required to have a bending strength based on the fineness of 5–20 d. When the fineness exceeds 20 d, however, the strength becomes too large to extremely reduce the number of appeared cone shapes undesirably.

The difference in fineness between the pile material B and the pile material A is preferably 18–1 d, more preferably 12–1 d from a viewpoint of the improved profile of the cone shape pile. It is desirable that the fiber length of pile materials A and B is nearly same or within 10 mm or less difference, if there is any difference, from a viewpoint of the improved profile of cone shape pile. It is preferable that each fiber length of the pile material A and the pile material B is about 32–51 mm in view of having scattered cone shape piles in the present invention.

For the cross-sectional profile of the pile material B, any shape can be chosen from, for example, round, kidney-shape, flat, oval, trilobal and tetralobal. To make the profile of cone shape pile more attractive to eyes, however, flat or oval shape is preferable. On the other hand, for the cross-sectional profile of the pile material A, it is allowed to choose the profile from, for example, round, kidney-shape and heart-shape. But since it is necessary for pile material A to be thoroughly blended with pile material B, round, kidney-shape or heart-shape is preferable.

With respect to a combination of cross-sectional profile of pile material A and pile material B, the combination selected from round, kidney-shape, flat and oval is preferable from a viewpoint of the profile of cone shape pile and the increased stability of the profile of the cone shape pile.

In addition, to increase the hue effects, a pile material C, a shrinkage component, might be blended in the range of 30% or less.

When pile materials A, B, C are used, the ratio of each pile material is 30–70% for the pile material A, 10–40% for the pile material B, and 30% or less for the pile material C (preferably 10% or more for the pile material C). Needless to say, the hue must be changed for the pile material C from that of the pile materials A and B. It is preferable to choose a fineness for the pile material C from 2–5 d, shrinkage ratio from 20–40% and a fiber length from 25–76 mm.

Pile materials A, B, C might be all chosen from raw white fibers, solution dyed fibers, or stock dyed fibers. The luster of the pile material can be freely chosen from dull and bright types.

The pile composite in the present invention is formed with slivers which are formed by uniformly blending the pile materials as described above and pulling them through a card.

The slivers before knit-in comprise pile material A and pile material B, and in some cases, pile material C which is used as required, and weighs 10–30 g/m.

The pile materials A, B, C are knitted in the ground fabric at the same time when the ground fabric is made.

The cone shape pile existing on the surface of the pile fabric consists of 10–80 pieces of fibers, and in addition, this cone shape pile wherein pile material A and pile material B are entangled is formed in double-deck construction in which the pile from the pile material B is used as a reference. In this event, the pile length in the form of cone is longer than the reference pile length. By using the pile material C, a shrinkage component, together for the reference pile portion, the hue effect is enhanced and the triple-deck construction can be achieved. In this event, the relation of cone shape pile > pile from the pile material A and B > pile from the pile material C is achieved with respect to pile length.

Both of the cone shape piles and other plain piles comprise pile material A, pile material B and/or pile material C. The cone shape pile consists of 10–80 pieces of fibers which entangle with one another. The cone shape pile can be clearly distinguished from other plain piles because of its characteristic shape and pile length.

The pile composite with the cone shape piles as described above has completely new specific appearance which has never existed before.

Next, the process for preparing the pile composite of the present invention will be explained.

Figure 2:
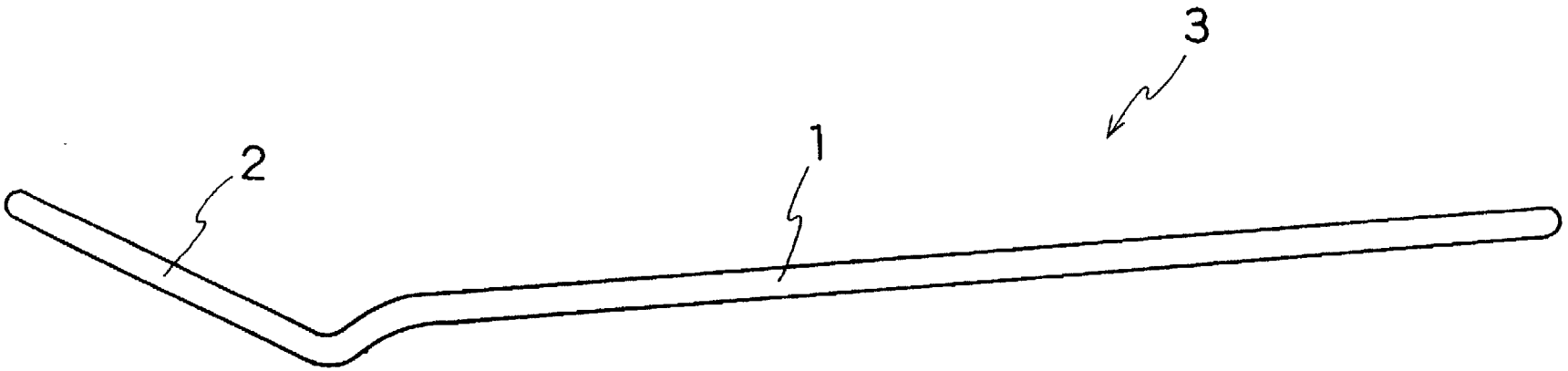
FIG. 2 is a schematic representation of another example of an accessory to be mounted near a card of a sliver knitting machine in the preparation process according to the present invention.

Using a sliver knitting machine in which an accessory 3 of a unique shape comprising a support 1 and a presser 2 doglegged against the support 1 as illustrated in FIGS. 1 and 2 is provided close to a latch needle inside a cylinder, slivers are knitted into the ground fabric. During knitting, a part of the pile chafes against the presser 2 and is partially bent. Then, the sliver knit-in fabric undergoes prepolishing, preshearing (polishing and shearing before coating is called prepolishing and preshearing, respectively), and coating; then, it undergoes finishing which combines polishing, shearing and brushing, and at last, it is subject to the tumbler processing to be formed into the pile composite of the present invention.

The shape of the presser preferably has a curvature radius equal to the cylinder diameter of the knitting machine, but it might be straight. The cross sectional profile of the presser might be any one of round, square, or rectangular, but the rectangular is preferable in order to efficiently develop cone shape pile.

The dimension of the accessory varies depending on the kind of sliver knitting machine used, but it is desirable for the effective length of the presser to be longer than the working width of a card from a viewpoint of efficiently developing cone shape pile.

For the accessory portion, it is preferable to bring the presser as close to the latch needle as possible as long as no operational interference occurs. That is, it is preferable to keep 5–20 mm for the shortest distance between the presser and the latch needle. It is also important to locate the lower tip end of the presser below the tip end of the latch needle and simultaneously above the top end of the sinker.

There is no limitation to the material of the accessory, but a smooth surface is preferable so that the pile material smoothly moves at the time of knitting. For example, the metal surface which is plated and then buffed is preferable.

The operating speed of the sliver knitting machine might be a normal rotating speed, and air velocity from a blower nozzle is preferably 20–30 m/sec.

After preparing the ground fabric into which sliver is knitted, the ground fabric generally undergoes prepolishing for removing fiber crimps, preshearing for keeping the pile length constant, and coating for increasing dimensional stability and preventing loose fibers. Thereafter, finishing takes place in which polishing, shearing and brushing for unraveling fibers are carried out.

In the preparation process of the present invention, finishing, particularly preshearing and tumbler processing carried out after knitting, is essential.

The shearing length is subject to the fiber length of pile materials A and B. Consequently, it is preferable to shear in the length of 30–50% of the fiber length. For example, when the fiber length is 38 mm, preshearing by 15 mm can produce 20–30 mm cone shape pile as final products.

It is preferable to carry out tumbler processing under the condition in which pile materials A and B are thoroughly agglomerated (thick pile material B and thin and soft pile material A are entangled to be formed into a thin writing brush form). Consequently, it is preferable to set the processing temperature in accordance with the pile material, but in general, preferably at 90°–130° C. When the pile material is modacrylic fiber, 90°–110° C. is optimum. If the processing time is 10–30 minutes, distinctive cone shape pile is formed.

Next, the above-mentioned method of preparing the pile composite is explained based on FIGS. 3 and 4 with taking notice of formation of cone shape piles. FIG. 3 is an explanatory view of process for preparing a pile composite with a double-deck construction, and FIG. 4 is an explanatory view of process for preparing a pile composite with a triple-deck construction.

Firstly, the pile composite with a double-deck construction is explained. Pile material A and pile material B are blended to prepare slivers with the use of a card. Then, using a sliver knitting machine with the above-mentioned accessory of a specific shape, a pile fabric is knitted. In that case, the frequency of appearance of cone shape piles changes depending upon the shape of accessory, conditions of knitting and the combination of pile materials.

Figure 3A:
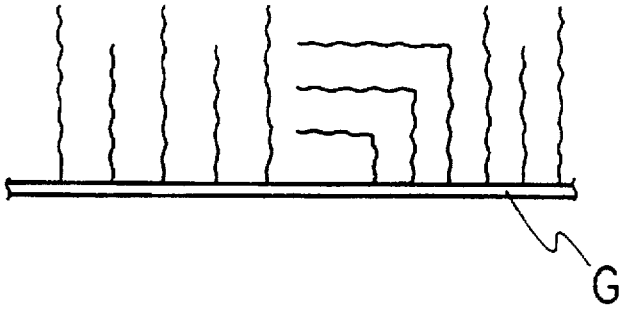
FIGS. 3A–D are explanatory views of the process for preparing a pile composite with a double-deck construction of the present invention.
Figure 3B:
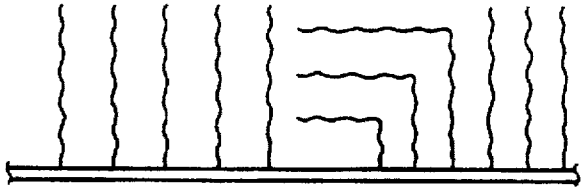
Figure 3C:
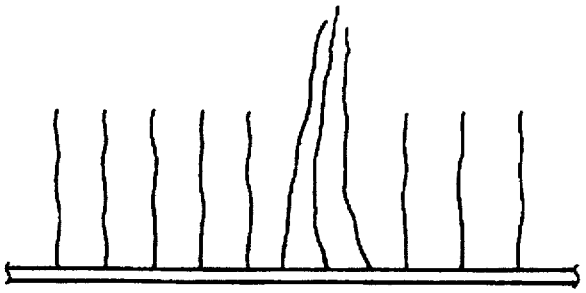
Figure 3D:
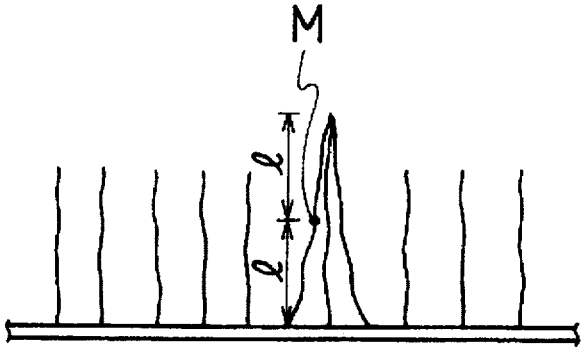

After slitting (FIG. 3*a*), the pile fabric obtained is prepolished and presheared, and coated with acrylic ester resin and the like on the rear surface of the pile fabric (FIG. 3*b*). Then, the pile fabric is subject to brushing treatment and polishing treatment (FIG. 3*c*). By brushing treatment, piles which would display cone shape are set up to have a longer pile length than the other piles. By polishing treatment, the crimp of each fiber is removed so that the fibers become substantially straight. The cone shape appears, and the feeling of touch and appearance of the pile fabric are improved. Final tumbler treatment allows the cone shape portion to entangle and form cone shape piles (FIG. 3*d*). Thus, there can be obtained a pile composite with a double-deck construction (two-layer construction) comprising plain piles other than cone shape piles as the first deck and cone shape piles as the second deck. The pile material A and pile material B are uniformly blended in the cone shape piles and other piles.

Figure 4A:
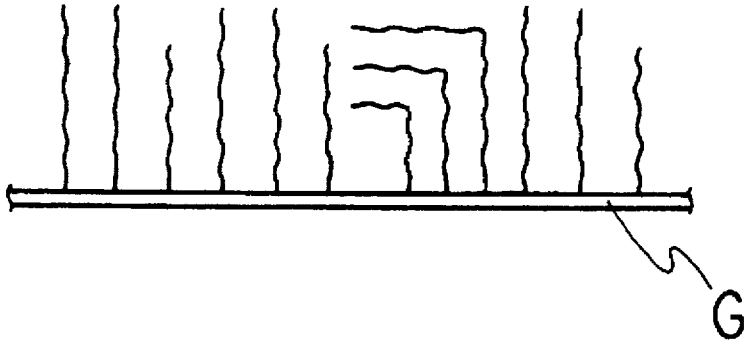
FIGS. 4A–C are explanatory views of the process for preparing a pile composite with a triple-deck construction of the present invention.
Figure 4B:
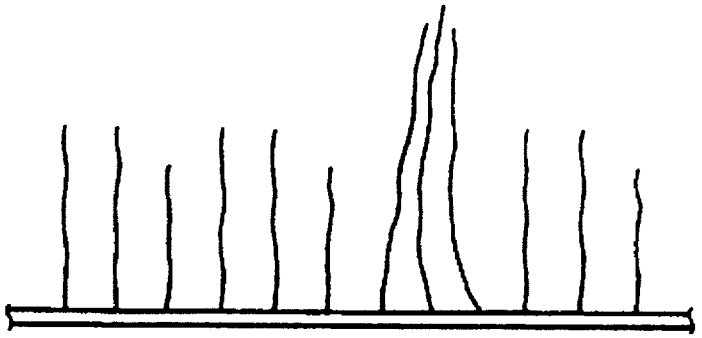
Figure 4C:
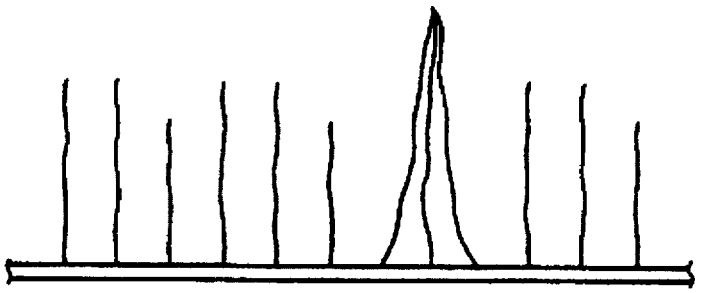

Next, the pile composite with a triple-deck construction is explained. In the case of pile composite with a triple-deck construction, pile materials A, B and C are used. Knitting and shearing processes are the same as in the case of double-deck construction shown in FIG. 3. After shearing treatment, the pile fabric is subjected to coating treatment with resin and then is dried at 110°–140° C. within five minutes to dry the resin and allow the material C to shrink (FIG. 4*a*). Then, the pile fabric is subjected to brushing treatment to remove the crimp of the fibers (FIG. 4*b*). Final tumbler treatment forms cone shape piles (FIG. 4*c*). Pile materials A, B and C are uniformly blended into cone shape piles and other piles.

Now referring to Examples, the present invention is specifically explained. The number of cone shape piles in the Examples were given by placing a base sheet with a 10×10 cm area cut out on a pile composite which had been complete with final finishing, counting the number of cone shape piles, and converting it to the number per 1 $m^2$. Further, the total area of the cone shape piles at middle portions thereof was obtained by observing the ten cone shape piles from the section of the pile fabric, measuring each diameter of the cone shape piles at their middle portion in the length direction, calculating an average diameter, and multiplying the average diameter by the number of cone shape piles counted.

EXAMPLE 1

After 50% of modacrylic fibers of 3*d* and 38 mm length (pile material A), 30% of modacrylic fiber of 6 d(flat) and 38 mm length (pile material B), and 20% of gray modacrylic fiber of 4 d(shrinkage component) and 32 mm length (pile material C) were thoroughly blended, 18 g/m of slivers were prepared.

Next, using a sliver knitting machine with an accessory as shown in FIG. 1 (a rectangular 110 mm-length presser 2 is connected to a support 1 to form an angle of 105°) mounted near each card on the sliver knitting machine, pile fabric was knitted from the slivers obtained, and paralleled ground yarns of spun yarns of acrylic fibers (30NE) and polyester filaments (150 d).

After completion of knitting, the pile fabric obtained was prepolished, presheared by 15 mm, coated so that acrylic ester resin was coated on the rear surface of pile fabric at a rate of 50 g/$m^2$, and subjected to a combined process of brushing and polishing for finishing, and finally the pile fabric was sheared by 30 mm.

This pile fabric was processed by a tumbler at 100° C. for 20 minutes and a pile composite was obtained.

The number of cone shape piles formed on the pile composite obtained was counted and the result indicated that there were 5200 pieces/$m^2$. Further, the total area of the cone shape fibers was 3.5% of an area of the ground fabric. This pile fabric had a triple-deck construction and was a pile composite with a completely new and specific appearance with cone shape piles.

EXAMPLE 2

After 70% of modacrylic fibers of 3 d and 38 mm length (pile material A) and 30% of modacrylic fiber of 6 d(flat) and 38 mm length (pile material B) were throughly blended, 20 g/m slivers were prepared.

Next, using a sliver knitting machine with an accessory as shown in FIG. 2 (a circular 100 mm-length presser 2 is connected to a support 1 to form an angle of 105°) mounted near each card of the sliver knitting machine, pile fabric was knitted from slivers obtained and ground yarns of 150 d×2 polyester filaments.

After completion of knitting, the pile fabric obtained was prepolished, presheared by 15 mm, coated so that acrylic ester resin same as that used for Example 1 was coated on the rear surface of pile fabric at a rate of 50 g/$m^2$. Thereafter, the pile fabric was subjected to a combined process of brushing and polishing for finishing, and finally it was sheared by 30 mm.

This pile fabric was processed by a tumbler at 100° C. for 20 minutes and a pile composite was obtained.

The number of cone shape piles formed on the pile composite obtained was counted and the result indicated that there were 2800 pieces/$m^2$. Further, the total area of the cone shape fibers was 0.9% of an area of the ground fabric. This pile fabric had a double-deck construction and was a pile composite with completely new and specific appearance with cone shape pile.

COMPARATIVE EXAMPLE 1

After 70% of modacrylic fibers of 3 d and 38 mm length (pile material A) and 30% of modacrylic fiber of 6 d(flat) and 38 mm length (pile material B) were thoroughly blended, 20 g/m slivers were prepared.

Next, using a regular sliver knitting machine, pile fabric was knitted from the slivers obtained and ground yarns of 150 d×2 polyester filaments.

After completion of knitting, the pile fabric obtained was prepolished, presheared by 15 mm, coated so that acrylic ester resin same as that used for Example 1 was coated on the rear surface of pile fabric at a rate of 50 g/m$^2$. Thereafter, the pile fabric was subjected to a combined process of brushing and polishing for finishing, and finally it was sheared by 30 mm.

This pile fabric was processed by a tumbler at 100° C. for 20 minutes and a pile composite was obtained.

An attempt was made to count the number of cone shape piles formed on the pile composite obtained but no cone shape pile was found.

The pile composite of the present invention has a specific appearance in which a large number of cone shape piles are developed on the surface of the pile fabric and can meet strong needs for pile composite with a specific appearance.

The pile composite of the present invention can be prepared by the preparation method of the present invention.

Though several embodiments of the present invention are described above, it is to be understood that the present invention is not limited only to the above-mentioned and various changes and modifications my be made in the invention without departing from the spirit and scope thereof.

What is claimed is:

1. A pile composite with specific appearance comprising a pile fabric obtained by sliver knitting process, the pile fabric including a ground fabric, substantially straight piles and cone shape piles, both of the piles being developed on the surface of the ground fabric, wherein the cone shape piles are scattered all over the ground fabric and a total area of the cone shape piles, when measured at middle portions in a height direction of the cone shapes piles, is from 0.5 to 15% of a unit area of the ground fabric.

* * * * *